United States Patent [19]

Stanko et al.

[11] Patent Number: 4,906,519

[45] Date of Patent: Mar. 6, 1990

[54] VARIABLE DENIER FILAMENTS AND METHOD OF PRODUCING SAME

[75] Inventors: Wayne S. Stanko, Asheville; Stuart H. Rice, Weaverville, both of N.C.

[73] Assignee: BASF Corporation, Williamsburg, Va.

[21] Appl. No.: 203,786

[22] Filed: Jun. 6, 1988

[51] Int. Cl.[4] ..... D03D 3/00

[52] U.S. Cl. ..... 428/224; 264/210.3; 428/364; 428/395; 428/400

[58] Field of Search ..... 428/364, 395, 400, 224; 264/210.3

[56] References Cited

U.S. PATENT DOCUMENTS

| | | | |
|---|---|---|---|
| 3,478,143 | 11/1969 | Werner et al. | 264/290 |
| 4,044,089 | 8/1977 | Cochran et al. | 264/167 |
| 4,147,749 | 4/1979 | Lipscomb et al. | 264/167 |
| 4,495,244 | 1/1985 | Phillips | 428/399 |

OTHER PUBLICATIONS

H. M. Behery and B. K. Porcher, "Effect of Crystallinity and Orientation on Oscillation During Drawing of Polyethylene Terephthalate", published in *Journal of Engineering for Industry*, Mar. 1982, pp. 175–181.

*Primary Examiner*—James J. Bell

*Attorney, Agent, or Firm*—Tom R. Vestal; Edward R. Sherer

[57] ABSTRACT

This invention pertains to variable denier filaments prepared from synthetic polymers having a glass transition temperature of at least 30° C. and yarns made therefrom. The filaments have longer length slubs, which results in their use in fabrics desiring a variable texture and dyeing effects. The filaments are prepared by drawing at ambient temperature a feeder yarn having sufficient molecular orientation at carefully controlled draw ratios and in draw zones having a specified length.

21 Claims, 3 Drawing Sheets

VARIABLE DENIER FILAMENTS AND METHOD OF PRODUCING SAME

BACKGROUND OF THE INVENTION

A. Field of the Invention

The present invention relates to synthetic polymer fibers or filaments having denier fluctuations or variations of random size in the direction of the axis thereof, yarns made therefrom, and a method of preparing same.

B. Description of the Prior Art

Man-made fibers are generally produced by spinning and drawing. In most instances, the fibers produced by this procedure are substantially uniform in thickness.

In certain applications, it is important that yarns contain filaments having a variable denier. For instance, such yarns are useful in providing the means of producing variable texture and dyeing effects in fabrics made therefrom. Thus, mottled or other novelty effects can be produced owing to the varying rates and extents to which dyestuff is taken up by the portions of different denier. Fabrics containing such yarns have an attractive appearance, i.e., a "busy" looking fabric, and a pleasing hand-feel.

The term "fiber" as used herein includes fibers of extreme or indefinite length (i.e., filaments) and fibers of short length (i.e., staple). The term "yarn" as used herein means a continuous strand of fibers.

The term "fabric" as used herein includes a textile structure composed of mechanically interlocked fibers or filaments. The structure can be nonwoven, woven, or knitted.

The term "multifilament yarn" as used herein means a multifilament yarn comprising a plurality of individual filaments or modification of said multifilament yarn.

A number of procedures have been proposed in the past for producing filaments having a variable denier. One such proposal involves a controlled irregularity in the feed rate of the filament-forming mass to the spinning nozzles. The pressure variations resulting from these controlled changes of the feed rate cause corresponding changes in the thickness of the resulting filament. Another proposal involves drawing off the filaments from the spinning nozzle at a variable or changing velocity. Still another procedure for producing filament-containing yarn having a variable denier involves drawing the filaments around a hot pin at lower than normal draw ratios and temperatures.

On particularly undesirable feature associated with many of these proposals is that the larger denier portions, sometimes referred to as "slubs", of the filaments have a short length. In order for a fabric containing the variable denier filaments to have a pleasing "linen-like" appearance, and/or to have attractive novelty effects, it is desirable that the fabric contain filaments having slubs of longer length.

The present invention provides filaments having longer slubs, even up to 8 times the length of previous variable denier filaments, which find particular application in fabrics where variable texture and dyeing effects are desirable.

SUMMARY OF THE INVENTION

The present invention provides synthetic polymer fibrous material, fibers or filaments, having a variable denier, i.e., thicker sections and thinner sections, which are distributed irregularly and, usually, alternately, in the direction of the filament or fiber axis. The thicker portions of the material have such lengths that multifilament yarn made from the material and the resulting fabrics have a number of desirable characteristics including a "linen-like" appearance.

It has been unexpectedly discovered that the filaments having the above-described features can be prepared from partially oriented feeder yarn having a birefringence ($\Delta n$) in the range of from about 0.01 to about 0.05 by drawing the yarn at ambient temperatures (15°-30° C.) at carefully controlled draw ratios and in a draw zone having a particular length.

The resulting thick and thin filaments contain slubs which preferably have a length in the range of from about 1.4 inches to 30.9 inches, an average length of slub of from about 9.1 to about 16.2 inches, and occupy from about 16.4 to about 49.8 percent of the longitudinal axis of the filament. More preferably, the slubs occupy from about 30.0 to about 49.8 percent of the longitudinal axis of the filaments. The above-recited percent of occupancy, length of slub, and average length of slub is obtained by measuring 50 feet of at least 10 filaments which have been selected at random.

DETAILED DESCRIPTION OF THE PREFERRED EMBODIMENTS

Figure 1:
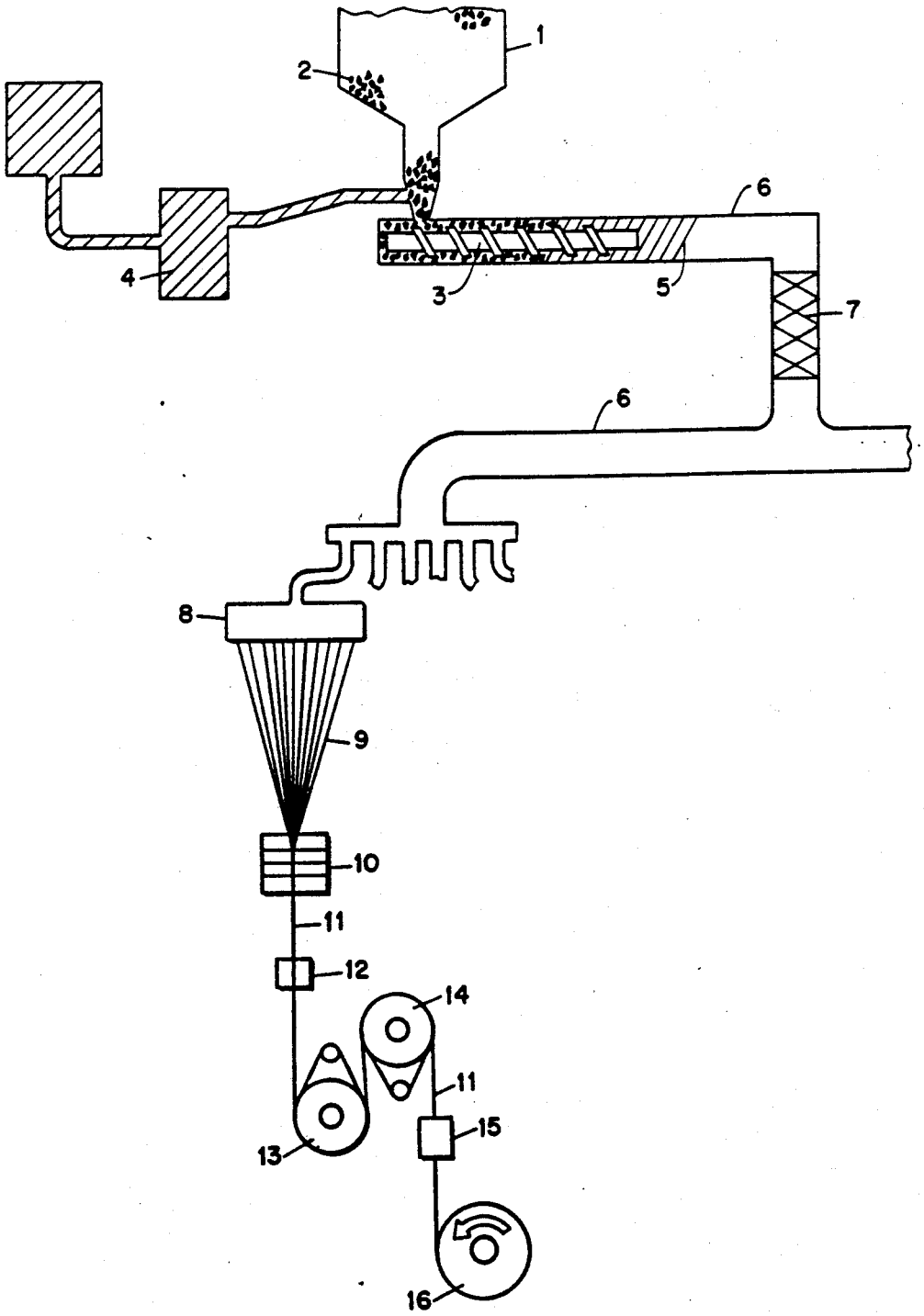
FIG. 1 is a partial schematic of the apparatus and process suitable for preparing the feeder yarn of the invention.

Fiber-forming synthetic polymers suitable for use in the present invention include synthetic polymers having a glass transition temperature ($T_g$) of at least 30° C.

The term "glass transition temperature" ($T_g$) means the temperature at which an amorphous polymer or the amorphous regions of a partially crystalline polymer changes to or from a hard and relatively brittle state to a more flexible or rubbery condition. At sufficiently low temperatures, all amorphous polymers or amorphous regions of semicrystalline polymers assume characteristics of glasses, such as hardness, stiffness, and brittleness. Polymers in the glassy state are characterized by a low volume coefficient of expansion, when compared with that of the polymer in the fluid state. In this respect, polymers in the glassy state resemble crystalline polymers which are also characterized by a low volume coefficient of expansion. The temperature interval at which the volume coefficient of expansion of the amorphous polymer changes from a high to a low value is the glass transition temperature range.

Preferred synthetic polymers include linear terephthalate polyesters (PET), i.e., polyesters of a glycol containing from 2 to 20 carbon atoms and a dicarboxylic acid component comprising at least about 75% terephthalic acid. The remainder, if any, of the dicarboxylic acid component may be any suitable dicarboxylic acid such as sebacic acid, adipic acid, isophthalic acid, sulfonyl-4,4-dibenzoic acid, or 2,8-dibenzofurandicarboxylic acid. Examples of linear terephthalate polyesters which may be employed include poly(ethyleneterephthalate), poly(butylene terephthalate), poly(ethyleneterephthalate/5-chloroisophthalate)(85/15), poly(ethyleneterephthalate/5-[sodium sulfo]isophthalate)(97/3), poly(cyclohexane-1,4-dimethylene terephthalate/hexahydroterephthalate) (75/25).

The preferred polyester is poly(ethylene terephthalate), which includes a linear polyester in which at least about 85% of the recurring structural units are ethylene terephthalate units of the following formula:

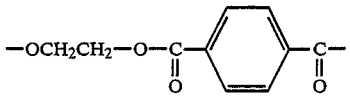

More preferably, the linear polyester contains at least ninety percent (90%) recurring structural units of ethylene terephthalate. In a particularly preferred embodiment of the process, the polyester is substantially all poly(ethylene terephthalate). Up to 15 mol percent of other copolymerizable ester units other than poly(ethylene terephthalate) can also be present.

The feeder yarn utilized to prepare the yarn and filaments of the present invention must have sufficient molecular orientation (birefringence—$\Delta n$). If the amount of molecular orientation of the feeder yarn is not sufficient, the resulting filaments are too weak or brittle. If the amount of molecular orientation of the feeder yarn is too great, the variable denier filaments of the present invention will not be produced from the feeder yarn. The amount of birefringence in the feeder yarn will an amount in the range of from about 0.01 to about 0.05, and, more preferably, from about 0.015 to 0.031, and, most preferably, about 0.018.

When the fender yarn comprises poly(ethyleneterephthalate), the feeder yarn is preferably prepared utilizing the following steps:

(a) extrude molten poly(ethylene terephthalate) having an intrinsic viscosity in the range of from about 0.4 to about 0.8, and preferably 0.64, through a spinnerette to form one or more filaments;

(b) quench said filaments, preferably to a temperature not exceeding 40° C. higher than the glass transition of the poly(ethylene terephthalate);

(c) optionally, apply to said filaments of step (b) an aqueous lubricating finish preferably in an amount in the range of from about 0.1 to about 1.0 weight percent based on the weight of the yarn; and, (d) take up said quenched filaments of step (b) or (c) at a take-up speed sufficient to impart sufficient molecular orientation to the feeder yarn.

In order for the feeder yarn to have sufficient molecular orientation, the take-up speed will generally be in the range of from about 1,600 to about 4,000 meters/minute, preferably, from about 1,800 to about 2,800 meters/minute, and most preferably, about 2,000 meters/minute.

In order to achieve maximum contrast between the thick and thin sections of the yarn, the feeder yarn is aged for a sufficient amount of time, i.e., 24 hours to 7 days.

The variable denier filaments of the present invention are prepared by drawing, at ambient temperature, i.e., 15°–30° C., the feeder yarn having the above described molecular orientation (birefringence) at a draw ratio of from about 1.27 to about 2.03 and in a draw zone having a length of from about 15.2 to about 300 cm. More preferably, the draw ratio is from about 1.67 to about 1.96 and the draw zone has a length of from about 30.5 to about 81.3 cm. Most preferably, the draw ratio is about 1.90 and the length of the draw zone is 61 cm.

The yarns comprising the variable denier filaments can be processed into fabrics which find particular use in draperies and upholstery fabrics.

Various characteristics and measurements are utilized throughout the application. These characteristics and measurements are grouped here for convenience, although most are standard.

The term "Uster" is a measurement of uniformity (denier variation) of the filaments. The Uster was measured by means of Uster Evenness Tester, Model II, using the procedures recommended by the manufacturer.

The term "Dynafil Shrinkage Force" is another measurement of uniformity of the filament which was measured on a Dynafil System ITM made by Textechno. The Dynafil apparatus provides an input roller running at a constant speed and an output roller running at the same constant speed. In between the input and output rollers, the yarn passes through a heater and around a wheel attached to a tension measuring device. As the yarn passes through the heater, its reaction to heat is measured as a change in tension caused by shrinkage. Since the orientation in the thick and thin sections of the yarn differs, the variation in the shrinkage force is a measure of the nonuniformity of the yarn. In this instance, the speed of the input and output rollers was 50 meters/minute. The heater temperature was 150° C.

Birefringence ($\Delta n$) is obtained in the following manner:

Sodium D rays (wavelength 589 millimicrons) are used as a light source, and the filaments are disposed in a diagonal position. The birefringence ($\Delta n$) of the specimen is computed from the following equation:

$$\Delta n = \frac{n\lambda + r}{\alpha}$$

when n is the interference fringe due to the degree of orientation of the polymer molecular chain; r is the retardation obtained by measuring the orientation not developing into the interference fringe by means of a Berek's compensator; $\alpha$ is the diameter of the filament; and $\lambda$ is the wavelength of the sodium D rays.

The crystal size (L) is a value obtained in accordance with the following (P. Scherrer's) equation, which represents the size of a crystal in a direction approximately at right angles to the fiber axis:

$$L(A) = \frac{\lambda K}{(B - b)\cos\theta}$$

wherein

B is a (010) diffraction peak width in radian unit when the diffraction intensity is (It+Iam)/2, in which I t is a diffraction intensity at (010) peak position, and I am is a meridional X-ray diffraction intensity at a Bragg's reflection angle of $2\theta = 17.7$;

The tenacity or breaking strength in grams per denier (UTS) is defined by ASTM Standards, Part 24, American Society for Testing and Materials, 1916 Race Street, Philadelphia, PA., page 33 (1965) as "the maximum resultant internal force that resists rupture in a tension test", or "breaking load or force, expressed in units of weight required to break or rupture a specimen in a tensile test made according to specified standard procedure". Elongation (E) is the measure of the change in length of the filament by tensile force and is determined by the following formula:

$$E = \left[ \frac{\text{Length at the Break Point}}{\text{Original Length}} - 1 \right] \times 100$$

Throughout the present specification and claims, the intrinsic viscosity of the polyester melt is given as a measure for the mean molecular weight, which is determined by standard procedures wherein the concentration of the measuring solution amounts to 0.5 g./100 ml., the solvent is a 60 percent by weight phenol/40 percent by weight tetrachloroethane mixture, and the measuring temperature is 25° C.

Figure 2:
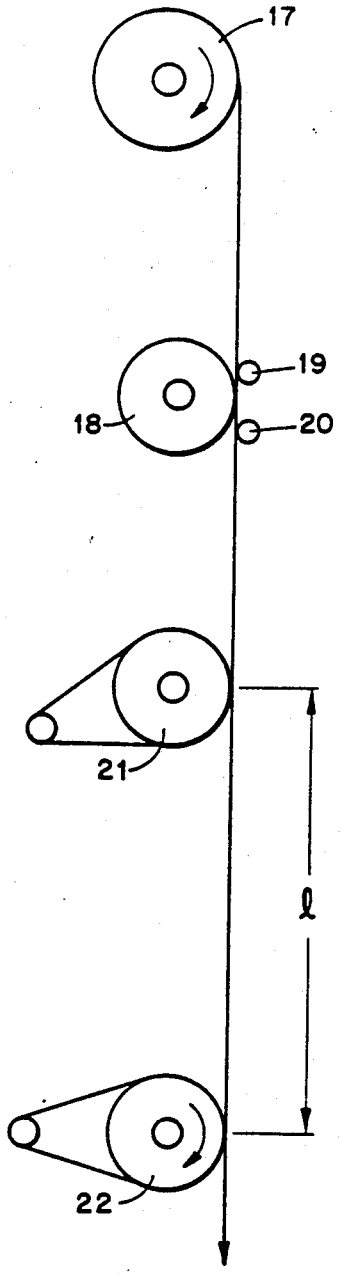
FIG. 2 is a partial schematic of an apparatus and process suitable for the drawing process of the invention.

The apparatus and process for preparing the variable denier filaments of the present invention are represented schematically in FIG. 1 and FIG. 2. With respect to FIG. 1, a method of preparing feeder yarn comprising poly(ethylene terephthalate) having sufficient molecular orientation (birefringence) is illustrated. The process comprises first supplying a chip hopper 1 with chips comprising poly(ethylene terephthalate) 2. The hopper 1 in turn supplies an extruder 3 with the chips 2. An additive pump 4 is also illustrated whereby various liquid additives such as pigments, heat stabilizers, antioxidants, etc., can be added, if desired, to the chip stream which is entering the extruder 3. Once the chips exit the extruder as a molten stream 5, the stream is pumped through a conduit 6 which contains a plurality of static mixers 7. Once through the static mixers 7, the mix stream enters the spinnerette 8 and is extruded into a plurality of molten streams 9 which are solidified in a quench chamber 10. The quench chamber is generally an elongated chimney of conventional length, preferably 60 to 80 inches, which has a gaseous atmosphere below the glass transition temperature of the molten polyester. The solidified filaments 11 next pass over an applicator 12 whereby the filaments are lubricated. Lubricants suitable for such use are known to those skilled in the art and include mineral oil, butyl stearate, alkoxylated alcohols, and phosphates or cationic antistatic compositions. The filaments next travel around a first (upstream) powered godet 13 and then around a second (downstream) godet 14, following which the yarn 11 is interlaced by an interlacer 15. Lastly, the filaments are wound-up onto a bobbin 16 at the previously described winding speeds. The filaments at this point are generally referred to as feeder yarn.

Referring to FIG. 2, the feeder yarn is fed continuously from package 17 by feed roll 18 by means of guides 19 and 20. The yarn is taken up and pretensioned between first godet 21 and feed roll 18 by means of the first godet 21. The amount of tension exerted on the yarn will generally be from about 15 to about 90 grams. Next, the yarn is taken up and drawn at ambient temperature in draw zone (l) by means of godet 22 at the draw ratios and draw zone lengths described heretofore. At this point, the yarn is ready to be wound on a pirn (not shown).

The filaments produced in accordance with the invention have a wide range of denier, i.e., 3 to 7, with no limitations. Total denier of the yarns for textile use will preferably be from about 70 to about 200 denier.

The invention is further exemplified by the examples below, which are presented to illustrate certain specific embodiments of the invention, but are not intended to be construed so as to be restrictive of the scope and spirit thereof.

EXAMPLE I

Poly(ethylene terephthalate) feeder yarn was prepared by melt spinning molten poly(ethylene terephthalate). The winding speed used in the preparation of the feeder yarn was 3,000 m/min. The resulting feeder yarn had the characteristics set forth in TABLE A.

TABLE A

| | |
|---|---|
| Birefringence | 0.035 |
| Denier | 270 |
| Tenacity, grams/denier | 2.20 |
| Elongation, % | 150 |
| Denier Unevenness, % C.V. | 0.84 |

Figure 3:
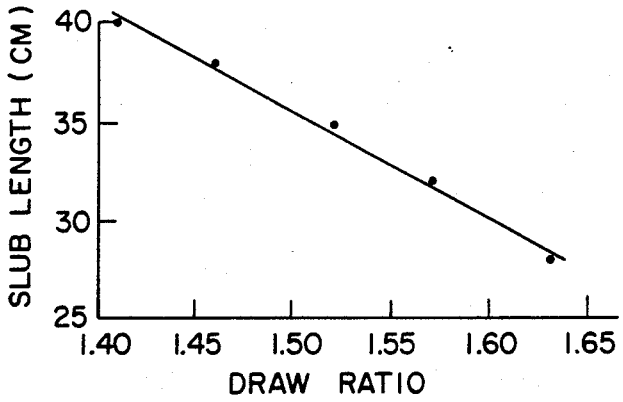
FIG. 3 represents a graph showing the relationship between draw ratio to slub length of the resulting yarn.

The resulting feeder yarn was aged for a period of about 24 hours. Then the yarn was drawn at various draw ratios in a draw zone having a length of about 35.6 cm. The results of these tests, which are shown in FIG. 3, demonstrate the relationship between draw ratio utilized on the feeder yarn and the resulting slub length of the variable denier yarn.

EXAMPLE II

A poly(ethylene terephthalate) feeder yarn was melt spun and wound up at a speed of 3,000 meters/minute. The feeder yarn was then drawn at various ratios and in a draw zone having a length of 35.6 cm. The resulting yarn was measured for Uster and Dynafil Shrinkage Force. The results of these measurements, which are reported as coefficient of variance of the denier of the filaments (CV), are set forth in Table B below.

TABLE B

| Test Sample | Draw Ratio | Dynafil Shrinkage Force (CN) | Dynafil Shrinkage % CV | Uster (% CV) |
|---|---|---|---|---|
| A | 1.63 | 20.1 | 2.54 | 1.16 |
| B | 1.57 | 16.9 | 5.42 | 1.16 |
| C | 1.52 | 14.7 | 5.13 | 1.43 |
| D | 1.46 | 13.1 | 4.75 | 1.40 |
| E | 1.41 | 12.0 | 4.74 | 1.34 |

The results of these tests demonstrate the relationship between uniformity of the resulting yarn and the draw ratio utilized on the feeder yarn.

EXAMPLE III

Figure 4:
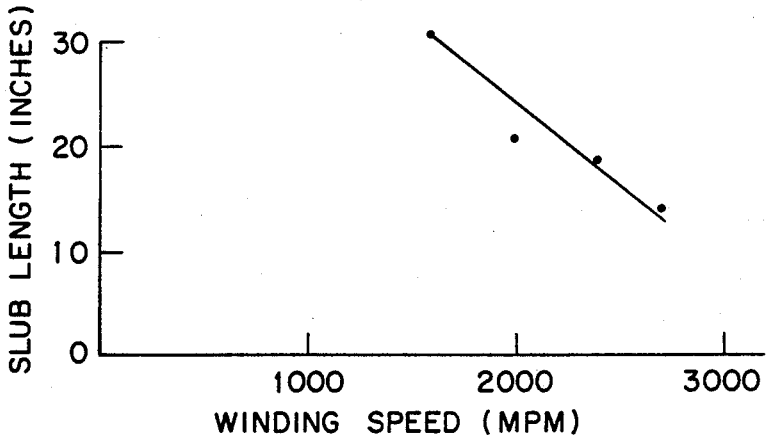
FIG. 4 represents a graph showing the relationship between slub length of the resulting yarn and winding speed of the feeder yarn.
Figure 5:
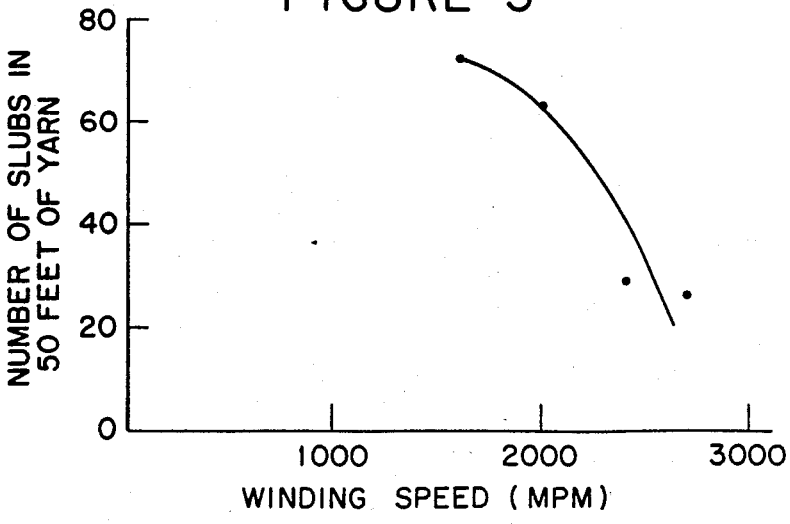
FIG. 5 represents a graph showing the relationship between the number of slubs in the resulting yarn and the winding speed of the feeder yarn.

A polyethylene terephthalate feeder yarn was melt-spun and wound up at various winding speeds. The feeder yarn was then drawn at ambient temperature, at a draw ratio range of 1.67 to 2.03, and in a draw zone having a length of 61.0 cm. The resulting yarn was evaluated for slub length, the number of slubs in the yarn, the thickness of the thick and thin sections, the slub length range, the percent slub in 50 feet of yarn, and average length of slub. These results are reported below in FIGS. 4 and 5 and Table C.

TABLE C

| Yarn Designation | Wind Speed (m/min) of feeder yarn [Birefringence] | Thick (Slub) Section Fiber Diameter (Microns) | Thin Section Fiber Diameter (Microns) | Thick Section/ Thin Section Ratio | Slub Length Range Minimum-Maximum (Inches) | % Slub in 50' of Yarn | Average Length of Slub (Inches) |
|---|---|---|---|---|---|---|---|
| A | 1,600 [0.014] | 32.6 | 22.4 | 1.46 | 1.4–30.9 | 49.8 | 16.2 |
| B | 2,000 [0.015] | 30.7 | 22.1 | 1.39 | 1.4–21.1 | 45.0 | 13.3 |
| C | 2,400 [0.023] | 30.0 | 22.9 | 1.31 | 2.8–19.7 | 19.2 | 11.2 |
| D | 2,725 [0.031] | 24.7 | 23.5 | 1.05 | 4.2–14.1 | 16.4 | 9.1 |

The results of these tests show that winding speed of the feeder yarn, which affects its birefringence, has a significant effect on the number of slubs, the distribution of the slubs, and maximum and minimum lengths of the slubs in the resulting yarn. As the winding speed increases, the values for the length, number, and maximum and minimum length decrease.

EXAMPLE IV

A feed yarn comprising polyethylene terephthalate filaments was prepared by melt-spinning molten polyethylene terephthalate and winding up the spun filaments at various winding speeds. The feeder yarns were then drawn at ambient temperature, a draw ratio range of 1.67 to 2.03, and a draw zone of either 12 inches or 24 inches. The length of the largest slub on the resulting yarn was then measured. The results thereof are shown in TABLE D.

TABLE D

| Test Sample | Winding Speed (meters/minute) [Birefringence] | Length of Longest Slub (Inches) 12" Draw Zone | 24" Draw Zone |
|---|---|---|---|
| A | 1,600 [0.014] | 16.1 | 30.9 |
| B | 2,000 [0.015] | 14.3 | 21.1 |
| C | 2,400 [0.023] | 12.5 | 19.7 |
| D | 2,725 [0.031] | 11.2 | 14.1 |

The results of these tests show that the utilization of longer draw zones produce longer slubs in the resulting yarn.

The invention is not limited to the above-described specific embodiments thereof; it must be understood, therefore, that the detail involved in the descriptions of the specific embodiments is presented for the purpose of illustration only, and that reasonable variations, which will be apparent to those skilled in the art, can be made in this invention without departing from the spirit and scope thereof.

What is claimed is:

1. A variable denier filament comprised of a synthetic polymer having a glass transition temperature of at least 30° C., said filament having thick and thin sections along its longitudinal axis and said sections have a length in the range of from about 1.4 to about 30.9 inches, an average slub length of from about 9.1 to about 16.2 inches, and said sections occupy from about 16.4 to about 49.8% of said longitudinal axis of the filament.

2. The filament recited in claim 1 wherein said synthetic polymer is a linear polyester comprising poly(ethylene terephthalate).

3. The filament recited in claim 2 wherein said sections occupy from about 30.0 to about 49.8% of the longitudinal axis of said filament.

4. The filament recited in claim 3 wherein linear polyester comprises at least 85% recurring structural units of ethylene terephthalate.

5. The filament recited in claim 4 wherein said thick and thin sections alternate along the longitudinal axis of said filament.

6. A multifilament yarn comprising the filaments of claim 2.

7. A fabric comprising the filaments of claim 4.

8. A method of preparing a yarn containing variable denier filaments comprised of a synthetic polymer having a glass transition temperature of at least 30° C. comprising drawing at ambient temperature a feeder yarn having a birefringence in the range of from about 0.01 to about 0.05 at a draw ratio in the range of from about 1.27 to about 2.03 and in a draw zone having a length of from about 15.2 to about 300 centimeters.

9. The method recited in claim 8 wherein said synthetic polymer is a linear terephthalate polyester.

10. The method recited in claim 9 wherein said linear terephthalate polyester is poly(ethylene terephthalate).

11. The method recited in claim 5 wherein said birefringence of said feeder yarn is from about 0.015 to about 0.031.

12. The method recited in claim 10 wherein said draw ratio is from about 1.67 to about 1.96.

13. The method recited in claim 12 wherein said draw zone has a length of from about 30.5 about 81.3 centimeters.

14. The method recited in claim 10 wherein the preparation of said feeder yarn comprises the following steps:

(i) extrude molten poly(ethylene terephthalate) having an intrinsic viscosity in the range of from about 0.4 to about 0.8 through a spinnerette to form one or more filaments;

(ii) quench said filaments;

(iii) apply an aqueous lubricating finish to said quenched filaments; and, (iv) take up said filaments at a speed in the range of from about 1,600 to about 4,000 meters per minute.

15. The method recited in claim 14 wherein said filaments are taken up at a speed of from about 1,800 to about 2,800 meters per minute.

16. The method recited in claim 15 wherein said feeder yarn is aged for about 24 hours after said filaments have been taken up.

17. The method of claim 16 wherein said filaments are taken up at a speed of about 2,000 meters per minute.

18. The method recited in claim 10 wherein said draw ratio is about 1.90 and said length of said draw zone is about 61 centimeters.

19. The method recited in claim 18 wherein said birefringence of said feeder yarn is about 0.018.

20. A yarn containing filaments produced in accordance with the method of claim 8.

21. A fabric containing filaments produced in accordance with the method of claim 8.

* * * * *

UNITED STATES PATENT AND TRADEMARK OFFICE

CERTIFICATE OF CORRECTION

PATENT NO. : 4,906,519

DATED : March 6, 1990

INVENTOR(S) : Wayne S. Stanko and Stuart H. Rice

It is certified that error appears in the above-identified patent and that said Letters Patent is hereby corrected as shown below:

In column 1, line 49, please change "On" to --One--.

In column 3, line 39, please change "fender" to --feeder--.

In column 5, line 65, please change "(1)" to --(ℓ)--.

Signed and Sealed this

Twentieth Day of August, 1991

*Attest:*

*Attesting Officer*

HARRY F. MANBECK, JR.

*Commissioner of Patents and Trademarks*